US006295684B1

(12) United States Patent
Skinner

(10) Patent No.: US 6,295,684 B1
(45) Date of Patent: Oct. 2, 2001

(54) APPARATUS FOR CLEANING LAMINATED SHEETS

(76) Inventor: Robert Skinner, 2510 - 13th Avenue, Regina, Saskatchewan (CA), S4P 0W2

( * ) Notice: Subject to any disclaimer, the term of this patent is extended or adjusted under 35 U.S.C. 154(b) by 0 days.

(21) Appl. No.: 09/298,162

(22) Filed: Apr. 23, 1999

(30) Foreign Application Priority Data

Nov. 12, 1998 (CA) ..... 2253957

(51) Int. Cl.[7] ..... B08B 1/02

(52) U.S. Cl. ..... 15/102; 15/77; 134/9; 134/122 R

(58) Field of Search ..... 15/102, 100, 77, 15/3, 103.5, 4; 156/584; 118/109, 111; 134/9, 122 R

(56) References Cited

U.S. PATENT DOCUMENTS 3,237,231 * 3/1966 Zink .
3,440,675 * 4/1969 Yeaman .
3,792,503 * 2/1974 Brock .
3,938,213 * 2/1976 DiFede .
4,129,919 * 12/1978 Fitch .
4,730,360 * 3/1988 Brugelmann .
4,733,422 * 3/1988 Schramm et al. .
5,428,856 * 7/1995 Thorne .
5,621,939 * 4/1997 Yoshida et al. .

FOREIGN PATENT DOCUMENTS

509785 * 10/1930 (DE) ..... 15/77

* cited by examiner

*Primary Examiner*—Gary K. Graham
(74) *Attorney, Agent, or Firm*—Koley Jessen P.C.; Mark D. Frederiksen

(57) ABSTRACT

An apparatus is disclosed for the cleaning of solubly marked laminated sheets. A laminated sheet is fed over a cleaning surface along which are disposed a plurality of solvent-carrying wipers. The solvent-carrying wipers will wipe the markings from the sheet and the sheet feeder will then deposit the wiped sheet at the other end of the apparatus. Drying means could wipe excess solvent from the sheet following its passage over the wipers. The device will be of particular assistance in the gaming industry, where reusable gaming cards might be substituted for disposable paper cards currently employed for substantial economic savings.

13 Claims, 4 Drawing Sheets

APPARATUS FOR CLEANING LAMINATED SHEETS

This invention deals with an apparatus which can be used to clean soluble markings from laminated sheets of paper or the like, which might be used in the gaming industry as playing cards or in other applications.

BACKGROUND

Gaming establishments, and in particular bingo halls, commonly use preprinted sheets of paper containing multiple bingo cards for sale to their customers. Of specific importance at present, and the problem which the present invention seeks to address, is that of the consumption of large quantities of paper as preprinted bingo cards. There are security concerns associated therewith, as well as purely environmental and economic concerns. See U.S. Pat. No. 5,687,971 to Khaladkar for further background.

Conventional paper bingo cards are thrown away after each game, since they are not reusable. Consumption of paper and ink makes up a large expense for bingo operators. For example, it is my understanding that approximately 52 million sheets of 11×17 inch bingo paper are used in the Province of Saskatchewan alone each year, which seems to equate to about 52 semi-trailer loads. Buying this paper represents a significant cost to bingo operators, not to mention the financial and environmental costs of the disposal of same once used. If the amount of paper used could be reduced ,the costs of operating a bingo would be positively affected.

Bingo establishments commonly have thousands of sheets of bingo paper "in inventory" at any one time. Many attempts have been made to lessen the cost and security risks associated with the holding of such inventory, with varying degrees of success.

It has been recognized that laminated paper and soluble marking ink might be employed rather than normal newsprint-type bingo paper, which would allow for the reuse of bingo cards. The use of a laminated paper with a fast-drying but soluble ink could lessen the consumption of paper considerably and lower the costs both to the operators and to the environment. Rather than moving about the bingo hall selling additional sheets of bingo paper between every game bingo workers could instead collect used cards for cleaning and sell cleaned cards or revalidate cards for replay in the system once a player used up the cards that they bought when they started.

Preferable to the cleaning of the sheets or gaming cards by the players at their tables, which would be messy, would be to have a large enough stock of reusable laminated bingo cards that used cards could be removed for cleaning elsewhere in the facility and clean cards could simply be sold.

The Khaladkar invention addresses many of the concerns of security and validation associated with the use of reusable card stock. The problem which the present invention seeks to address, however, is the need for an efficient method of wiping the used bingo cards clean. The number of sheets of cards which would be in play at any one time would mean that to manually wipe them clean would take significant manpower. This would seem to be one of the only limitations to the broad deployment of laminated reusable bingo paper in the gaming industry.

SUMMARY OF THE INVENTION

It is the object of the present invention to provide an apparatus for the cleaning of solubly marked sheets of laminated paper or the like. The particular goal is to provide a method of washing for marked sheets of bingo paper so that reusable laminated bingo sheets could be used rather than the paper cards currently employed in the industry.

It is the further object of the present invention to provide a mechanized method of cleaning said laminated sheets, to minimize personnel and resource requirements in the employment of reusable laminated sheets.

The invention, an apparatus for use in the cleaning of solubly marked laminated sheets by a solvent, each of said sheets having at least one solvent impermeable face carrying soluble markings thereon, accomplishes its objectives comprising a cleaning surface, said cleaning surface having an intake end and an output end between which is defined a cleaning path; a sheet feeder which moves a solubly marked laminated sheet over the cleaning surface along the cleaning path from the intake end, with the solubly marked face of the sheet facing the cleaning surface, and deposits said sheet at the output end; a solvent source containing solvent; a plurality of sheet wipers disposed on the cleaning surface along the cleaning path, each sheet wiper having a wiping surface facing upwards from the cleaning surface which will contact the solubly marked face of a sheet as it is fed over the cleaning surface; the solvent source being in communication with the sheet wipers so that solvent is communicated from the solvent source to the wiping surfaces.

One or more sheet wipers could be used, each of which could take many forms. A first most basic embodiment of a sheet wiper would be a simple pad.

Another form of a sheet wiper which is specifically contemplated is a cleaning roller. The sheet wipers could be cleaning rollers, wherein each said cleaning roller is rotated the mounted on an axis transverse to the cleaning path; and has a portion thereof exposed along or above the cleaning surface which is the wiping surface, the remaining portion of each roller below the cleaning surface being the under-surface portion.

A rotary drive might be connected to such cleaning rollers. The cleaning rollers could be rotated either towards or away from the output end by the rotary drive, although rotation of the cleaning rollers towards the output end is particularly contemplated to provide the best cleaning results. In the case of an embodiment of the invention employing more than one cleaning roller as sheet wipers, the cleaning rollers might be linked to a rotary drive in tandem such that the rotation of all of the cleaning rollers would take place in the same direction and at the same speed. This would also reduce the amount of rotary drive equipment required.

In either the case of a cleaning pad, or a cleaning roller configuration, the solvent source might be a reservoir located directly below the cleaning surface wherein, in the case of the cleaning roller, the under surface portion of each cleaning roller would pass through the solvent contained in the reservoir as the cleaning roller was rotated, solvent thus being communicated from the reservoir to the cleaning surface as the cleaning roller continues its rotation and the under surface portion having been immersed in the solvent rolls into position as the wiping surface. In the case of the solvent source being a reservoir located below the cleaning surface wherein the sheet wipers were pads, solvent may even be communicated to the cleaning surface as simply as by allowing the portion of the pad below the cleaning surface to be immersed in the solvent and the solvent being drawn upwards to the cleaning surface through the pad.

Another method of communicating solvent from the solvent source to the cleaning surface would be to use permeable cleaning rollers, wherein the cleaning rollers are hollow with permeable walls and solvent would be communicated to the wiping surface of each roller from the solvent source by pumping the solvent into the rollers wherefrom it will flow out of the permeable walls of the roller onto the surface of the roller. In this case it would be necessary to employ a swivelling hydraulic coupling to apply solvent continuously to the roller as the roller was rotated.

As indicated above, one or more cleaning rollers might be used. The rotary drive for the rollers, if used, could be a motor. The rollers might be connected to the rotary drive by way of a belt, or chain, or otherwise.

To further improve the cleaning rollers, an interchangeable cleaning sleeve could be added on each cleaning roller. These could be changed as they wore out. A solvent-permeable rigid core might further be added to the sleeve in order to make its replacement simpler and to render the sleeve more robust in its use.

Furthermore, where a soft sleeve was used over top of the cleaning rollers, at least one cleaning sleeve press roller might be added for each cleaning roller, such press roller or rollers likely being located below the cleaning surface and in proximity to the cleaning roller such that the cleaning sleeve disposed on the cleaning roller would be pressed between the cleaning roller and the press roller as those two rollers were rotated. This would press the dirty solvent remaining in the sleeve out of the sleeve as the sleeve rotated between the cleaning roller and the press roller. The cleaning sleeve press roller or rollers might also be connected to a drive, or alternatively might be allowed to rotate freely.

Many types of sheet feeders are also contemplated as operable within the scope of the present invention. The basic sheet feeder which is contemplated is a belt or vacuum feeder such as is employed in a photocopier or other conventional document handling machine, wherein the sheet feeder has the capacity for drawing into itself multiple marked laminated sheets, one at a time, and will feed them one after another across the cleaning surface.

In the case of a belt type sheet feeder a rotary drive for the cleaning rollers may not be necessary, since the belt of the sheet feeder moving along the cleaning surface and over top of the cleaning rollers might itself provide the necessary power to rotate the cleaning rollers.

In the case of an embodiment of the invention being built for less strenuous use, a manually operated sheet feeder might also be contemplated.

The cleaning process can be altered by varying the speed of rotation of the cleaning rollers in relation to the speed of the sheet feeder, or vice versa.

A return might be added whereby a excess solvent would be recovered from the cleaning surface. One such return might comprise a plurality of apertures in the cleaning surface through which solvent could flow into a reservoir located below the cleaning surface.

One or more sheet dryers might also be added to the apparatus along the cleaning path between the wiping means and the output end, each said sheet dryer having absorbent drying surface exposed along the cleaning path where it will contact the wiped face of the sheet as it passes over the sheet dryer, to dry excess solvent from the wiped sheet.

One or more sheet dryers might be used.

A drying fan might also be added below the cleaning surface to assist in drying the recovered solvent from the sheet dryers to whatever extent possible.

Different types of sheet dryers could be used although rotary dryers are contemplated. A rotary sheet dryer would be a drying roller with absorbent surface, being rotatably mounted on an axis transverse to the cleaning path, each drying roller having a portion thereof exposed along or above the cleaning surface which portion is the absorbent drying surface, the remaining portion of each drying roller below the cleaning surface being the under surface portion.

As indicated above generally, one or more drying rollers might be employed. Furthermore, a rotary drive might be added for connection to the drying roller or rollers. The drying roller or rollers might be rotated either towards or away from the output end of the cleaning surface.

Drying pads might also be used as the sheet dryers, rather than drying rollers.

As in the case of the cleaning rollers outlined above, the absorbent surface of each drying roller might be an interchangeable absorbent sleeve, with or without a rigid core, allowing for simple replacement.

The invention also discloses a method of cleaning solubly marked laminated sheets by a solvent, said sheets each having at least one solvent impermeable face carving soluble markings thereon, wherein the method comprises feeding the solubly marked face of the sheet across a cleaning surface having an intake end and an output end between which is defined cleaning path, via a sheet feeder which moves said marked laminated sheet from the intake end along the cleaning path, with the marked face of the sheet facing the cleaning surface, and deposits the wiped sheet at the output end; said sheet being wiped with solvent as it passes over the cleaning surface.

That method might be also improved by adding this step of drying the sheet as it passes along the cleaning surface, after it has been wiped with solvent and before the sheet is deposited at the output end.

The method disclosed by the present invention might be practiced using any of the embodiments of the apparatus disclosed herein, or there may be other types of apparatus which could be used which would also accomplish the same goal of the method of the present invention.

It is particularly contemplated that the apparatus and method of the present invention could be used where the markings on the laminated sheets were water soluble, and the solvent employed by the apparatus and the method was water. It will be understood, however, that other combinations of solvent and ink might also be arrived at which would work equally well in this type of an invention.

The device of the present invention has particular application to the cleaning of reusable laminated gaming cards in the bingo or casino industry, but will also be equally applicable and of equal utility in other functions where the cleaning of laminated sheet stock is required.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

The present invention comprises an apparatus for the cleaning of laminated sheets. The invention would appear to have particular applicability to the gaming industry, where the implementation of reusable gaming cards could represent a significant cost and environmental saving. In any event, for the purposes of the following detailed description, the laminated sheet could be taken to mean any sheet of plastic or some other solvent impermeable material carrying soluble markings on at least one of the two faces thereof. The apparatus then is intended to clean the soluble markings from the marked surface of the laminated sheet using a solvent so that the laminated sheet may be remarked and reused.

Figure 1:
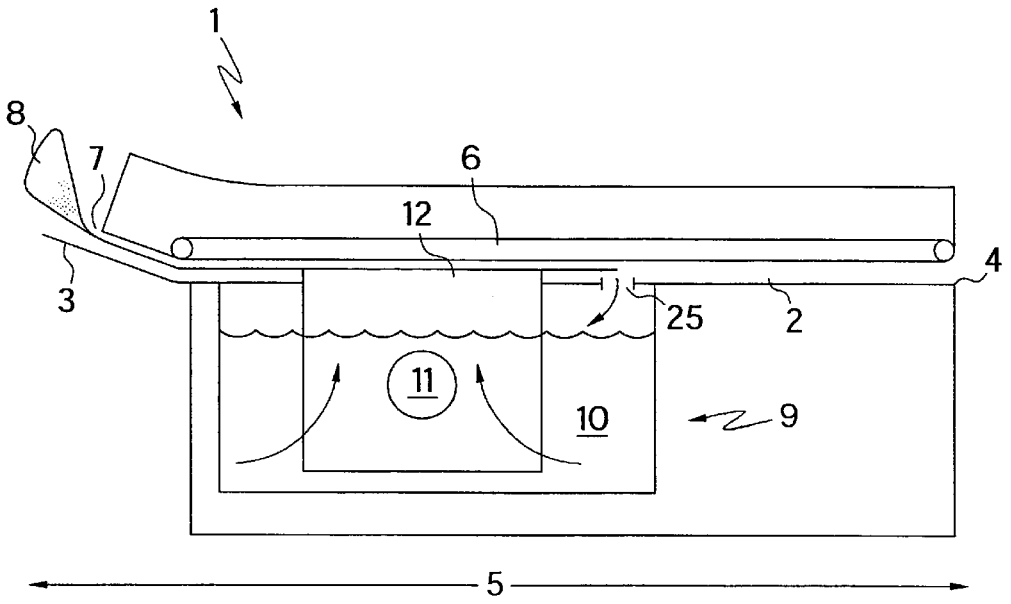
FIG. 1 is a drawing of the basic embodiment of the invention wherein the plurality of sheet wipers consists of one cleaning pad, and the solvent source is a reservoir located below the cleaning surface, in contact with the pad.

Referring first to FIG. 1, one basic embodiment of the invention is shown. Specifically, the invention, an apparatus 1 for use in the cleaning of solubly marked laminated sheets by a solvent, has a cleaning surface 2. The planar cleaning surface 2 has an intake end 3 and an output end 4, the cleaning surface 2 between said ends 3 and 4 defining a cleaning path 5.

Many materials could be used to construct the cleaning surface 2, and it will be understood that they are all contemplated within the scope of the present invention. As well, while the cleaning surface as shown is planar, it will be understood that other surface profiles could also be used such as a curve or the like, and that other such surfaces are contemplated within the scope of the present invention.

The next element of the apparatus of the embodiment shown in FIG. 1 is a sheet feeder 6. The sheet feeder 6 is used to move a marked laminated sheet 7 from the intake end 3 of the cleaning surface, along the cleaning path 5 for cleaning, to deposit the wiped laminated sheet at the output end 4. Also shown is the solubly marked face of the sheet 8, which is required to be cleaned by the apparatus 1.

The sheet feeder 6 as shown is a motor driven belt feeder, such as those known in the art for use on photocopiers or other document handling machines. It will be understood that various other sheet feeders might also be used, however, which would also be contemplated within the scope of the present invention so long as they accomplish the goal of moving the laminated sheet across the cleaning surface.

The next element of the apparatus 1 is a solvent source containing solvent. Many different solvent sources can be contemplated. The solvent source might be a reservoir or, conversely, could consist of a pumping apparatus or, in a more basic embodiment, could actually just be a hose connected to a pressurized solvent source. In this case the solvent source is a reservoir 9 located below the cleaning surface 2. The reservoir 9 contains solvent 10, which in the case of a laminated sheet carrying water soluble markings would be water.

The next element of the invention is a plurality of sheet wipers 1 1, which are disposed on the cleaning surface 2 along the cleaning path 5. In this case the plurality of sheet wipers is one cleaning pad 11. The cleaning pad 11 has a wiping surface 12 which faces upwards from the cleaning surface 2 and which will contact the marked face 8 of the sheet as it is fed over the cleaning surface 2 by the sheet feeder 6.

The solvent source 9 is connected to the cleaning pad 1, so that solvent 10 is communicated from the solvent source 9 to the wiping surface(s) 12. Solvent could be fed to the absorbent wiping surface of the cleaning pad or pads from the reservoir by pumping the solvent up through the pad or, alternatively, as shown in this Figure the pad 11 might just extend down into the reservoir 9 far enough that it was in contact with the solvent 10 contained therein, and the solvent 10 would then be drawn to the upper wiping surface 12 of the pad 11 by its natural flow through the pad 11. While this approach is not described in any further detail at this time, it will be understood that the use of pads, or any other such equivalent apparatus, which accomplishes the same goal of wiping the sheet as it is fed along the cleaning surface are contemplated within the scope of the present invention insofar as they might be obvious to one skilled in the art.

It will be understood that in an embodiment employing pads as the sheet wipers 11 the solvent source 9 might be a reservoir located directly below the cleaning surface 2 or might alternatively be a remotely located source connected by a pump or otherwise.

Also show in this FIG. is a return whereby excess solvent 10 could be returned from the cleaning surface 2 to the reservoir 9. In this case the return 25 consists of a series of apertures in the cleaning surface 2 through which solvent 10 can flow back to the reservoir 9.

Figure 2:
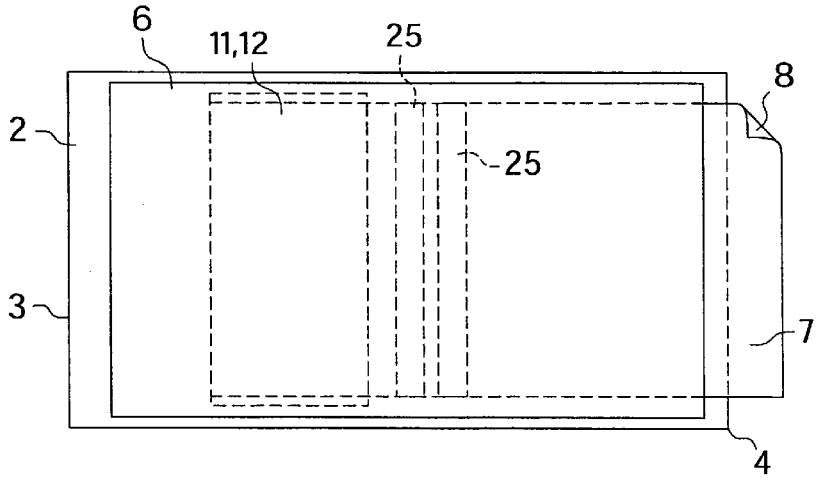
FIG. 2 is a top view of the embodiment of FIG. 1.

FIG. 2 shows a top view of the embodiment of FIG. 1.

Figure 3:
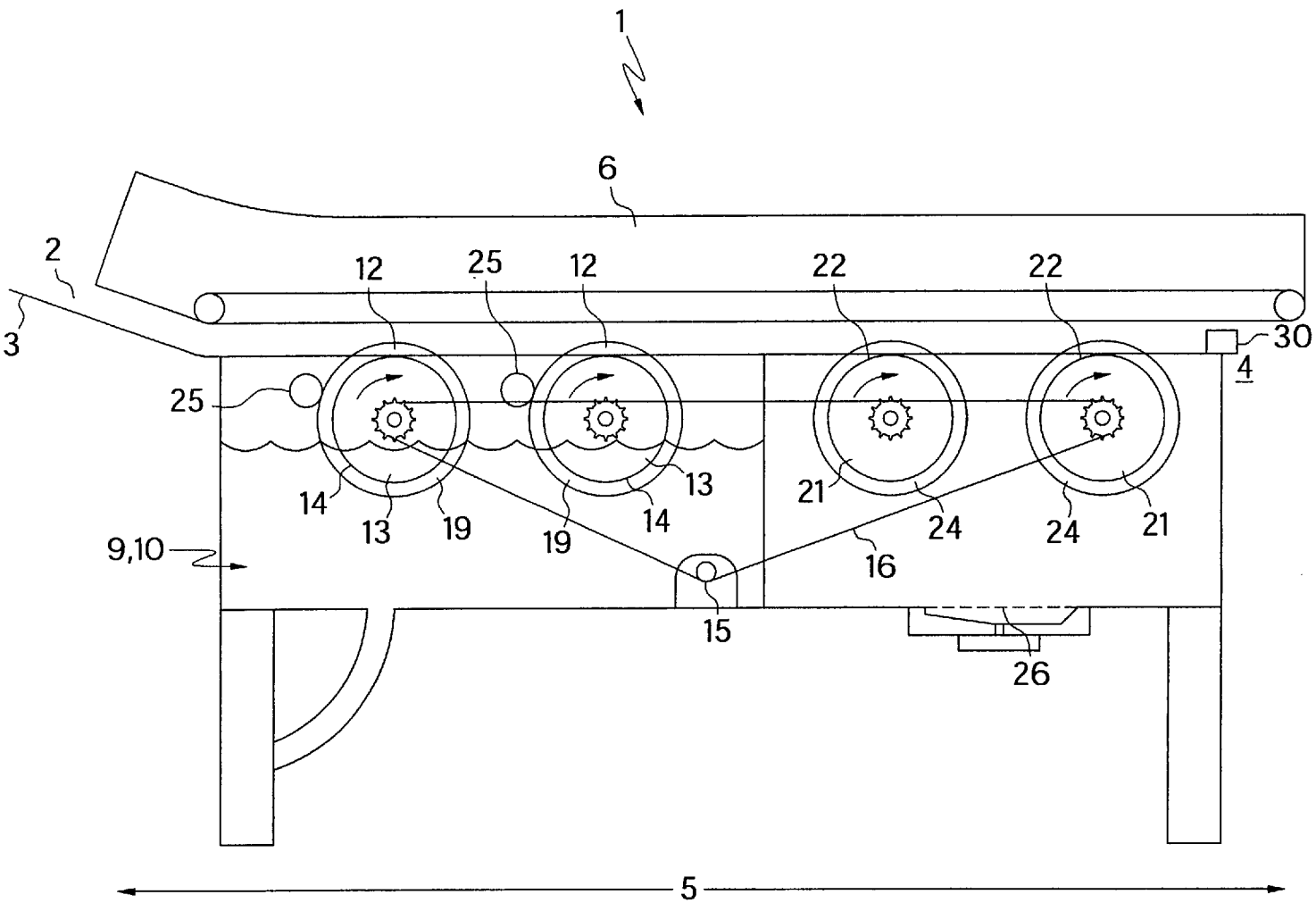
FIG. 3 is a view of another embodiment of the present invention wherein the plurality of sheet wipers are two cleaning rollers, also showing a plurality of sheet dryers, being two drying rollers.
Figure 4:
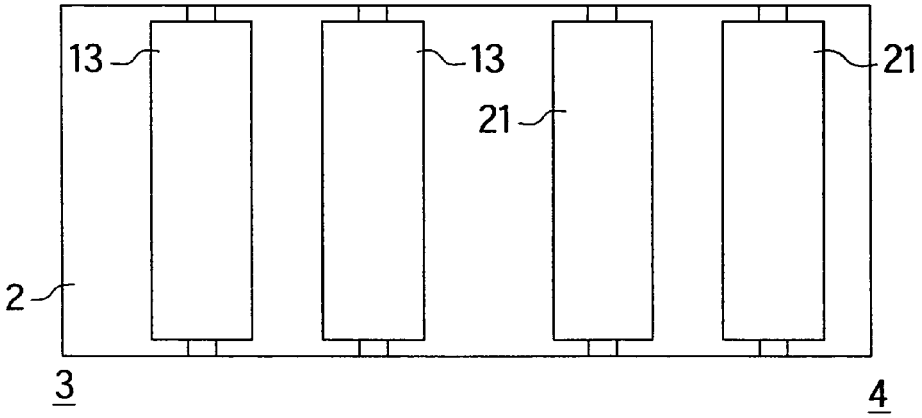
FIG. 4 is a top view of the embodiment of FIG. 3 with the sheet feeder removed.

FIGS. 3 and 4 show a more intricate embodiment of the present invention, incorporating more features. Again, there is shown in apparatus 1 with a cleaning surface 2, said cleaning surface 2 having an intake end 3 and output end 4 defining a cleaning path 5. Again, a sheet feeder 6 is shown, which is used to feed a laminated sheet(s) with a solubly marked face facing towards the cleaning surface 2 along the cleaning path 5 from intake end 3 to output end 4. The sheet feeder 6 might be a conventional vacuum and/or belt sheet feeder, as is known in the art of photocopiers, fax machines and the like. It will be understood that any mechanism which accomplishes the objective of mechanically feeding a laminated sheet along the cleaning surface is contemplated within the scope of the present invention. By making the sheet feeder variable in speed, the apparatus 1 could be made even more flexible.

The embodiment of FIGS. 3 and 4 also employs sheet wipers, which in this particular embodiment are cleaning rollers 13. Two cleaning rollers 13 are shown. Each cleaning roller 13 is rotatably mounted on an axis transverse to the cleaning path 5, such that each cleaning roller 13 will roll in the direction of the cleaning path 5. Each cleaning roller 13 is mounted within a fitting in the cleaning surface 2 so as to have a portion thereof exposed along or above the cleaning surface 2. This exposed portion of the cleaning roller 13 forms the wiping surface 12. The remainder of the cleaning roller 13, which is disposed below the cleaning surface 2, is the undersurface portion 14.

Connected to the cleaning rollers 13 is a rotary drive 15, which is a motor. A single motor 15 could be used to drive all of the cleaning rollers 13, where more than one cleaning roller 13 is used, or separate motors could be employed on each roller 13. It will be understood that the most economical and efficient way of operating the apparatus would be to connect all of the cleaning rollers 13 to the single motor 15 in such a manner as they are all driven in tandem when the motor 15 is engaged. In the case of the embodiment of FIGS. 3 and 4, a roller drive belt 16 is shown, which also connects to the drying aspect of the apparatus 1, which will be discussed in more detail below. Again similar to the sheet feeder 6, by rendering the motor 15 adjustable in speed, the flexibility and configuration of the device could be increased.

The cleaning rollers 13 would not necessarily need to be mounted on an axis fully perpendicular to the cleaning path 5. Rather, it will be understood that they could be angled to some extent from the perpendicular and still accomplish their objects. It will be understood that any such variations in the angle of the cleaning roller(s) 13 in relation to the cleaning path 5, so long as the same goal of wiping a laminated sheet passing thereover is accomplished, are contemplated within the scope of the present invention.

While it is particularly contemplated that the rotation of the cleaning rollers 13 towards the output end 4 by the motor 15 by whatever drive mechanism 15 is used, it will also be understood that in certain instances, the cleaning rollers 13 might actually be rotated towards the input end 3, provided the sheet feeder 6 has sufficient power to drive the laminated sheet 7 across the counter-rotary force of the cleaning rollers 13.

Demonstrated herein as the solvent source 9 is a reservoir located directly below the cleaning surface 2. The undersurface portion 14 of each cleaning roller passes through the solvent 10 contained in the reservoir 9 as the cleaning roller 13 is rotated, the immersion of the undersurface portion 14 of the cleaning roller in the solvent 10, resulting in the communication of solvent from the reservoir 9 to the wiping surface 12 of the cleaning roller as well as to the cleaning surface 2 of the apparatus 1.

One or more sheet wipers might be used. In this case two cleaning rollers 13 are shown. It will be understood, however, that the invention as claimed encompasses the use of one or more sheet wipers and as such any number of sheet wipers or cleaning rollers would fall within the scope of the present invention.

It is also foreseen that the addition of apparatus to dry the excess solvent from the laminated sheet once it passes over the sheet wipers might be favored. One way of doing this might be to add a plurality of sheet dryers disposed along the cleaning path 5 between the sheet wipers 11 and the output end 4. In this case two drying rollers 21 are shown. Each drying roller 21 has a drying surface 22 for drying the sheet 7 as it passes thereover. It is particularly contemplated that the drying surface 22 might be an absorbent surface, to soak in the excess solvent as the sheet 7 passes over.

While the sheet dryers demonstrated herein take the form of rollers, it will be understood that other dryers might also be used to accomplish the same goal, such as an absorbent non-roller pad 30, a forced air outlet, or some other variant, all of which are contemplated within the scope of the present invention insofar as they accomplish the goal of drying excess solvent from the sheet as it passes along the cleaning surface past the sheet wipers.

One or more drying rollers could be used. While two sheet dryers are shown in this embodiment, it will be understood that either one or more than two sheet dryers will both be understood to fall within the scope of the invention as claimed.

The sheet dryers in this embodiment being rollers 21 could also be attached to a drive. They could either be attached to individual motors, or in tandem to a single drive motor, or in the case of the embodiment shown are connected in tandem along with the cleaning rollers 13 to the singular motor 15.

A fan 26 could be added to blow air on the under surface portion 24 of the drying rollers 21 as they rotate in an effort to evacuate some of the solvent therefrom before the under surface portion 24 returns to the cleaning surface 2 to clean another portion of the sheet.

An interchangeable cleaning sleeve could also be used on each cleaning roller. The use of such a cleaning sleeve, shown at 19; would allow for the addition of a removable textured surface to the roller 13 in order to improve the cleaning action of the roller 13 vis-a-vis the sheet 7, or alternatively it could also improve the carriage of solvent 10 by the roller 13 from the solvent source 9 to the cleaning surface 2.

Similarly, an interchangeable absorbent drying surface might be added to the drying roller or rollers 21 by way of a removable drying sleeve 24.

In the case of an absorbent pad-type cleaning surface or cleaning sleeve 19 used on one or more of the cleaning rollers, one or more cleaning sleeve press rollers might be added to press the dirty solvent out of the surface as the under surface portion 14 of the cleaning roller rolls past the cleaning sleeve press roller. In the embodiment of FIG. 3, one cleaning sleeve press roller 25 is shown in association with each cleaning roller 13.

FIG. 4 shows a top view of the embodiment of FIG. 3 with the sheet feeder 6 removed.

The number of sheet wipers might be one, as demonstrated in the embodiment of FIGS. 1 and 2 or, alternatively, might be two or more as demonstrated in the embodiment of the remaining Figures.

Figure 5:
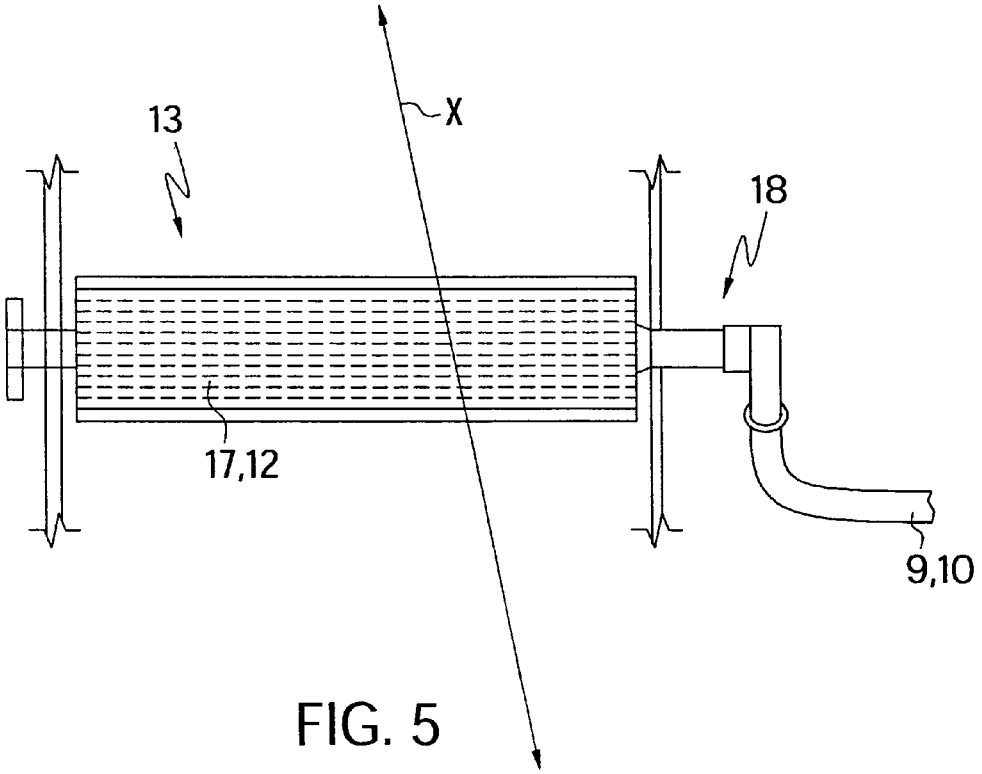
FIG. 5 is a partial top view of the embodiment of FIG. 3 demonstrating the permeable cleaning roller.
Figure 6:
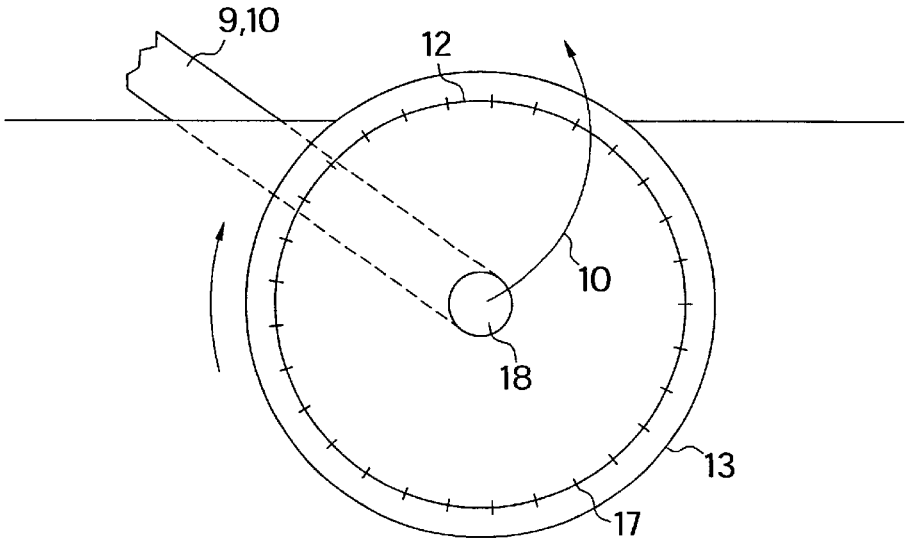
FIG. 6 is a cross sectional view along line X of the embodiment of FIG. 5.

An alternative to the direct immersion of the undersurface portion 14 of a cleaning roller 13 in a reservoir 9 containing solvent 10 is demonstrated in the apparatus of FIGS. 5 and 6. The cleaning rollers 13 are hollow with permeable walls 17 and solvent 10 is communicated to the wiping surface 12 of each roller 13 from the solvent source 9 by pumping said solvent 10 into the hollow rollers 13 wherefrom it will flow out of the permeable walls 17 of the rollers 13 onto both the wiping surface 12 of the roller as well as to the laminated sheet passing along the cleaning surface 2. In such an embodiment, the solvent source 9 might be a hose and pump arrangement or, alternatively, could even be a hose connected to some type of a permanent pressure system. In the case where the solvent is water, the solvent source could just be a water hose. The solvent source of such an embodiment, the hose, could be connected to the roller 13 via a swivel coupling 18, so that the solvent 10 could be communicated to the rollers 13 while the rollers 13 rotate.

Again in the case of the permeable rollers demonstrated in FIGS. 5 and 6, an interchangeable cleaning sleeve could be employed, and/or a plurality of cleaning sleeve press rollers.

It will also be understood that the motorized belt feeder/sheet feeder 6 could be rotated more quickly than the cleaning rollers 13, rather than rotating both drive units at the same speed, in order to alter the scrubbing motion applied to the mark face of each laminated sheet as it passes along the cleaning surface 2. It will be understood, however, that any such differentials or variations in the drive speed of either the cleaning rollers 13 or the sheet feeder 6 are all contemplated within the scope of the present invention.

It will be understood that a double-sided marked sheet could also be cleaned by simply feeding the sheets through the apparatus one side at a time. Some type of a more complex duplexing unit could also be contemplated and, although the specific construction of such a duplexing unit is beyond the scope of the present invention, it will be understood that the cleaning which would be performed by such an apparatus is contemplated within and would fall between the bounds of the claimed invention.

Figure 7:
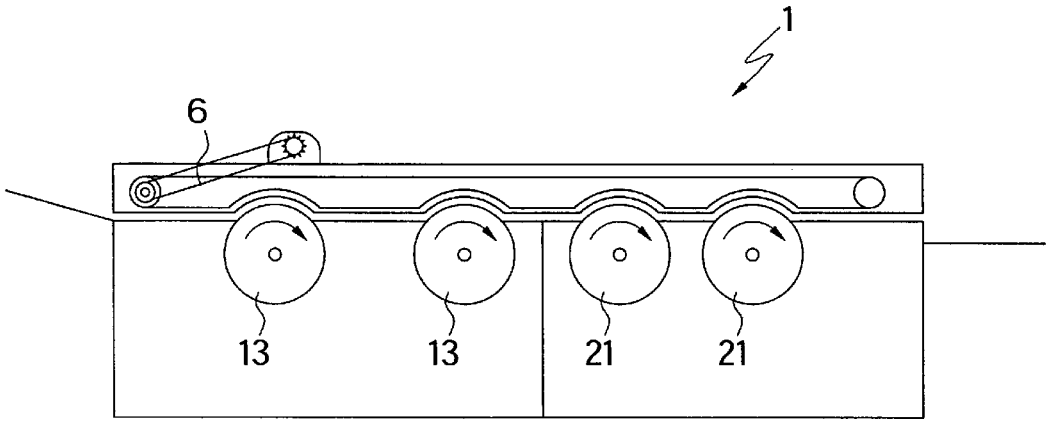
FIG. 7 demonstrates the cleaning path curving up over the wiping surface of each cleaning roller and the drying surface of each drying roller as the sheet is fed across the cleaning surface.

FIG. 7 demonstrates a further alteration to the basic concept The sheet feeder 6 and the rollers 13, 21 of the embodiments of FIGS. 3 to 6 have been modified so that they cooperate to move the sheet in closer conformity over a larger portion of the rollers 13, 21, resulting in a stronger scrubbing action being exerted on the sheet 7.

In operation of the device of the present invention, one or more marked laminated sheets carrying soluble markings on at least one impermeable face thereof are loaded into the sheet feeder. The sheet feeder is operated to feed the sheets one at a time along the cleaning path 5 over the cleaning surface 2. As the sheet travels along the cleaning surface 2, with the marked face of the sheet 8 facing downward towards the cleaning surface 2, the sheet wipers engage the sheet and apply solvent thereto, thus dissolving the soluble markings from the face thereof. In the case of an embodiment also including sheet dryers, the sheet dryers will wipe the excess solvent from the face of the sheet as the sheet passes thereover on its way to be deposited at the output end 4. It is this basic concept which is intended to fall within is the scope of the present invention. The various changes which can be made to this basic device as described herein will render certain improvements to this basic process.

The invention also discloses a method of cleaning solubly marked laminated sheets by a solvent, said sheets each having at least one solvent impermeable face carrying soluble markings thereon, wherein the method comprises feeding the solubly marked face of the sheet across a cleaning surface having an intake end and an output end between which is defined cleaning path, via a sheet feeder which moves said marked laminated sheet from the intake end along the cleaning path, with the marked face of the sheet facing the cleaning surface, and deposits the wiped sheet at the output end; said sheet being wiped with solvent as it passes over the cleaning surface.

That method might be also improved by adding this step of drying the sheet as it passes along the cleaning surface, after it has been wiped with solvent and before the sheet is deposited at the output end.

The method disclosed by the present invention might be practiced using any of the embodiments of the apparatus disclosed herein, or there may be other types of apparatus which could be used which would also accomplish the same goal of the method of the present invention.

The present invention is a method and apparatus for the cleaning of solubly-marked laminated sheets. The particular type of sheets used makes little difference to the operation of the apparatus of the present invention. So long as the sheets are shaped such that they can easily be handled by the apparatus, and for that matter the apparatus can be built to handle sheets of different sizes and even shapes, and so long as the faces of the sheets are impermeable to solvent, the remainder of the characteristics of the sheet might be a design decision. For example a typical laminated sheet might consist of a printed sheet of paper sealed between two sheets of plastic film or having some other type of an impermeable coating applied thereto. Alternatively there may be a case where the laminated sheet is only a sheet of plastic or some other impermeable material with permanent non-soluble markings thereon which would not be removed by the apparatus of the present invention. There may even be a case where a "blank" was used —a laminated sheet with no printed markings at all, which could basically be used as a writing tablet of sorts and then cleaned using this apparatus for reuse. It will be understood that any such sheet which is capable of being fed through the apparatus of the present invention of the purpose of cleaning soluble markings therefrom is contemplated within the scope of the present invention and the non-soluble contents of any such sheet are immaterial to the operation of the invention.

The type of ink used to mark the laminated sheets is not material either, as long as the ink used has available an aqueous solvent which can be used to wipe the ink from the incremental sheet. Water solubly could be used, and the solvent used in the apparatus of the present invention might then simply be water, or alternatively some other combination might be used. In the particular case of the bingo industry it may even be the case that some proprietary ink and solvent combination were created, but again, so long as the solvent is aqueous it will be understood that any such combination is contemplated to fall within the scope of the present invention.

Given the flexibility of the present invention, it could have utility in many industries beyond the bingo or gaming industry. It will be understood that such uses of the device outside of the bingo or gaming industry are still contemplated within the scope of the present invention and are intended to be covered by the claims hereof.

Thus it can be seen that the invention accomplishes all of its stated objectives. The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

I claim:

1. An apparatus for use in the cleaning of solubly marked laminated sheets by a solvent, each of said sheets having at least one solvent-impermeable face carrying soluble markings thereon, said apparatus comprising:

a cleaning surface, said cleaning surface having an intake end and an output end between which is defined a cleaning path;

a continuous sheet feeding belt which moves a solubly marked laminated sheet over the cleaning surface along the cleaning path from the intake end, with the solubly marked face of the sheet facing the cleaning surface, and deposits said sheet at the output end;

a solvent source containing solvent;

at least one sheet wiper disposed on the cleaning surface along the cleaning path, the sheet wiper having a wiping surface facing upwards from the cleaning surface which will contact the solubly marked face of a sheet as it is fed over the cleaning surface; the solvent source in communication with the sheet wipers so that solvent is communicated from the solvent source to the wiping surfaces.

2. The apparatus of claim 1 wherein the sheet wiper comprises a cleaning roller rotatably mounted on an axis transverse to the cleaning path and having a portion thereof exposed along or above the cleaning surface which is the wiping surface, the remaining portion of the roller below the cleaning surface being the under-surface portion.

3. The apparatus of claim 2 further comprising a rotary drive connected to the cleaning roller.

4. The apparatus of claim 3 wherein the cleaning roller is rotated towards the output end of the cleaning surface by the rotary drive.

5. The apparatus of claim 4 wherein the solvent source is a reservoir located directly below the cleaning surface and the under-surface portion of the cleaning roller passes through the solvent in the reservoir as each cleaning roller is rotated, solvent thus being communicated from the reservoir to the cleaning surface as the cleaning roller continues its rotation and the under-surface portion having been immersed in the solvent rolls into position as the wiping surface.

6. The apparatus of claim 5 wherein the cleaning roller is hollow with a permeable wall, and solvent is communicated to the wiping surface of each roller from the solvent source by pumping it into the hollow rollers wherefrom it will flow out of said permeable wall onto the surface of the roller.

7. The apparatus of claim 5 further comprising a cleaning sleeve press roller rotatably mounted on an axis substantially parallel to the axis of the cleaning roller, and located under the cleaning surface and above the solvent such that a surface of the cleaning sleeve press roller bears against a surface of the cleaning roller as same rotates up out of the solvent.

8. The apparatus of claim 1 further comprising a return for the removal of excess solvent from the cleaning surface.

9. The apparatus of claim 1 further comprising at least one sheet dryer disposed along the cleaning path between the sheet wiper and the output end.

10. The apparatus of claim 9 wherein the sheet dryer comprises a drying pad with an absorbent drying surface exposed along the cleaning surface.

11. The apparatus of claim 9 further comprising a drying fan located below the cleaning surface to assist in drying the recovered solvent from the sheet dryer.

12. The apparatus of claim 9 wherein the sheet dryer comprises a drying roller, and wherein the drying roller:

has an absorbent surface; is rotatably mounted on an axis transverse to the cleaning path;

has a portion thereof exposed along or above the cleaning surface which is the absorbent drying surface, the remaining portion of each roller below the cleaning surface being the under-surface portion.

13. The apparatus of claim 12 wherein the absorbent surface of the drying roller is an interchangeable absorbent sleeve.

* * * * *